US007259529B2

(12) United States Patent
Tanaka

(10) Patent No.: US 7,259,529 B2
(45) Date of Patent: Aug. 21, 2007

(54) CHARGED PARTICLE ACCELERATOR

(75) Inventor: Hirofumi Tanaka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 192 days.

(21) Appl. No.: 10/544,806

(22) PCT Filed: Feb. 12, 2004

(86) PCT No.: PCT/JP2004/001470

§ 371 (c)(1),
(2), (4) Date: Aug. 8, 2005

(87) PCT Pub. No.: WO2004/073364

PCT Pub. Date: Aug. 26, 2004

(65) Prior Publication Data

US 2006/0152177 A1 Jul. 13, 2006

(30) Foreign Application Priority Data

Feb. 17, 2003 (JP) ..... 2003-037694

(51) Int. Cl.
*H05H 7/00* (2006.01)

(52) U.S. Cl. ..... 315/501

(58) Field of Classification Search ..... 315/500, 315/501, 505, 506; 204/298.04, 298.05; 118/723 R, 723 MR, 723 VE
See application file for complete search history.

(56) References Cited

U.S. PATENT DOCUMENTS 4,197,510 A * 4/1980 Szu ..... 315/502
5,789,875 A * 8/1998 Hiramoto et al. ..... 313/505
6,433,494 B1 * 8/2002 Kulish et al. ..... 315/500
6,441,569 B1 * 8/2002 Janzow ..... 315/502

FOREIGN PATENT DOCUMENTS

JP 01-204399 8/1989

OTHER PUBLICATIONS

Aiba et al. "Development of a FFAG Proton Synchrotron", Proceedings of EPAC, pp. 581-583 2000.
Maruzen Company, "Accelerator Science (Parity Physics Course)", Betatron, Ch. 4, pp. 39-43 1993.

* cited by examiner

*Primary Examiner*—Shih-Chao Chen
*Assistant Examiner*—Minh Dieu
(74) *Attorney, Agent, or Firm*—Oblon, Spivak, McClelland, Maier & Neustadt, P.C.

(57) ABSTRACT

The present invention provides a charged particle accelerator comprising a charged particle generating apparatus, a bending magnet, accelerating means and a vacuum duct, wherein first and second acceleration periods (22), (23) are provided, accelerating electric field of the accelerating means is applied from the start time (25) of the first acceleration period (22) until the end time of the second acceleration period (23), and bending magnetic field is applied at a fixed value during the first accelerating period while, during the second acceleration period, it is applied so as to increase until the end time of the second acceleration period. Accordingly, there is provided a compact and high power charged particle accelerator which can perform large-current acceleration.

17 Claims, 5 Drawing Sheets

CHARGED PARTICLE ACCELERATOR

TECHNICAL FIELD

This application is a 371 of PCT/JP04/0140 Feb. 12, 2004.

The present invention relates to a circular particle accelerator for accelerating charged particles, and particularly to a compact charged particle accelerator for enabling acceleration of a large-current beam.

BACKGROUND ART

As a conventional charged particle accelerator is known an FFAG (Fixed Field Alternating Gradient) accelerator in which magnetic field generated by a bending magnet is fixed and an equilibrium orbit is expanded to the outside of a round orbit while accelerating charged particles. (See non-patent document 1, for example).

Furthermore, a betatron is known as an accelerator in which an equilibrium orbit is not varied and acceleration is carried out along a fixed orbit. (See non-patent document 2, for example).

[Non-patent document 1]

"Development of a FFAG proton synchrotron" Proceedings of EPAC 2000, Vienna Austria 2000. pp 581-583, FIG. 1.

[Non-patent Document 2]

Accelerator Science (Parity Physics Course) issued on Sep. 20, 1993 by Maruzen Company, Chapter 4 BETATRON, pp 39-43, FIG. 4.1.

According to the FFAG accelerator disclosed in the non-patent document 1, a beam generated by an ion source is injected to the accelerator, and accelerated by electric field applied to an accelerating cavity while going along a substantially circular orbit under bending magnetic field of a bending magnet. During the acceleration, the bending magnetic field of the bending magnet is fixed, and the equilibrium orbit is shifted to the outside of the accelerator while the beam is accelerated.

The magnetic field strength of the bending magnet increases toward the outside thereof, however, the overall dimension of the apparatus is increased because the magnetic field of the bending magnet is fixed, so that it is difficult to miniaturize the apparatus and thus an application field is limited.

According to the betatron accelerator disclosed in the non-patent document 2, the equilibrium orbit is fixed during acceleration of charged particles, large-current acceleration is difficult because of a space charge effect caused by coulomb scattering and time-averaged beam power is weak, so that this accelerator is hardly applicable to industrial and medical fields.

The present invention has been implemented to solve the above problems, and has an object to provide a charged particle accelerator which is remarkably compact like a lap-top type of about 30 cmϕ and large-current acceleration can be performed when electrons as charged particles are accelerated, thereby expanding applications to industrial and medical fields and other fields.

Furthermore, the present invention has an object to provide a compact accelerator even when protons, carbons or the like as charged particles are accelerated.

DISCLOSURE OF THE INVENTION

According to the present invention, a charged particle accelerator is equipped with a charged particle generating apparatus, a bending magnet, accelerating means and a vacuum duct, wherein charged particles injected from the charged particle generating apparatus into the vacuum duct are bent by the bending magnet and accelerated to have prescribed energy after passing through a first acceleration period and a second acceleration period, electric field generated by the accelerating means is applied from the start time of the first acceleration period until the end time of the second acceleration period, and magnetic field generated by the bending magnet is applied at a fixed value during the first acceleration period and applied while being increased until the end time of the second acceleration period.

Furthermore, according to the present invention, a charged particle accelerator is equipped with a charged particle generating apparatus, a bending magnet, accelerating means and a vacuum duct, wherein charged particles injected from the charged particle generating apparatus into the vacuum duct are bent by the bending magnet and accelerated to have prescribed energy after passing through a first acceleration period and a second acceleration period, a beam extraction period linked to the second acceleration period is provided, electric field generated by the accelerating means is applied from the start time of the first acceleration period until the end time of the extraction period, and magnetic field generated by the bending magnet is applied at a fixed value during the first acceleration period, the magnetic field is increased until the end time of the second acceleration period during the second acceleration period, and the magnetic field is applied during the extraction period a terminal value of the second acceleration period.

According to the charged particle accelerator of the present invention, there can be achieved such excellent effects that the accelerator can be miniaturized to be compact, a space charge effect can be suppressed, a high intensity beam can be accelerated and a high intensity beam having high quality can be achieved.

BEST MODES FOR CARRYING OUT THE INVENTION

Embodiment 1

An embodiment 1 of the present invention will be described hereunder with reference to FIGS. 1 and 2.

Figure 1:
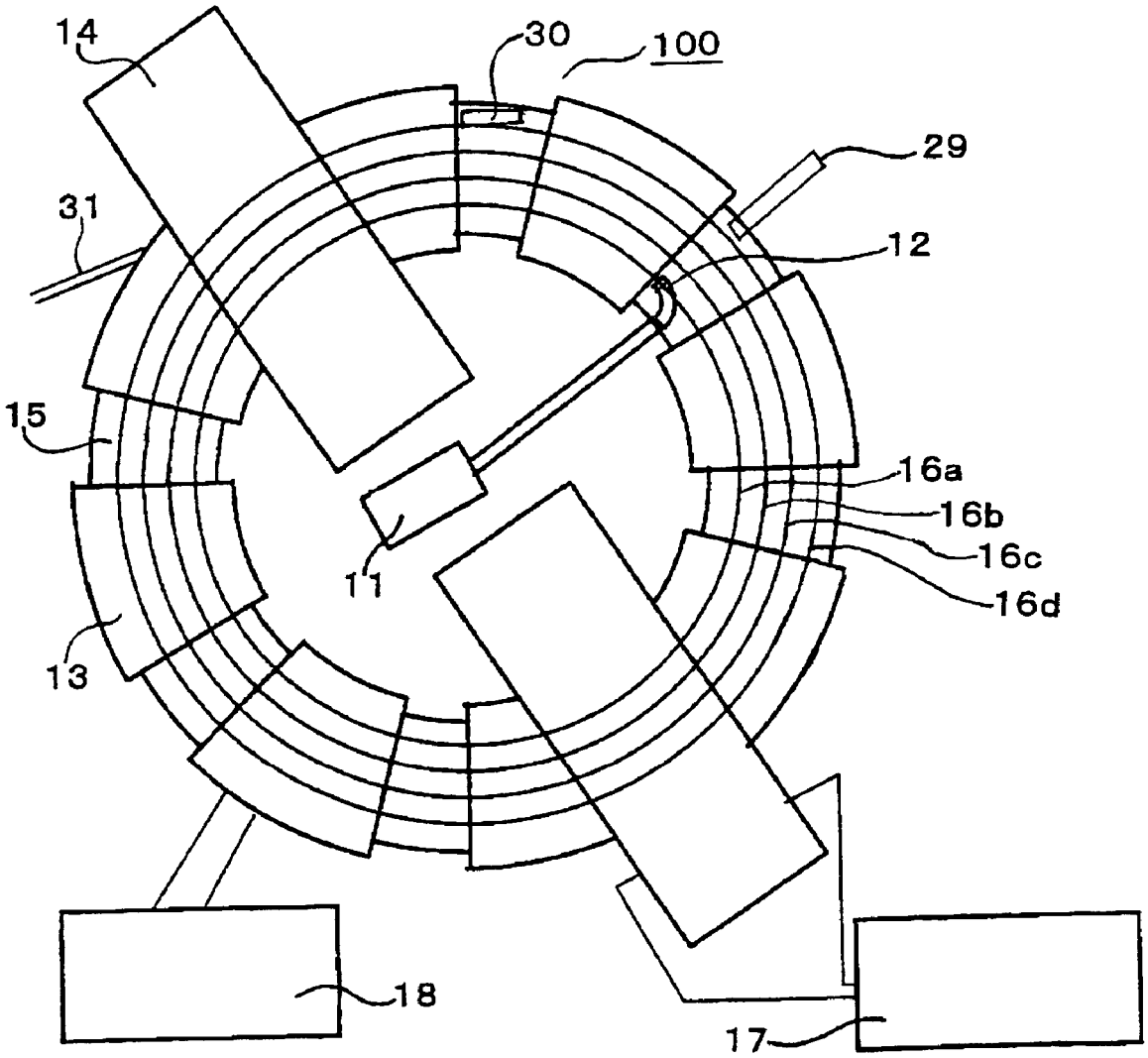
FIG. 1 is a plan view showing a charged particle accelerator according to embodiments 1 to 5 of the present invention.

FIG. 1 is a plan view showing a charged particle accelerator 100.

In FIG. 1, a charged particle beam (hereinafter referred to as beam) generated by a charged particle generating apparatus 11 is injected from a septum electrode 12 into a vacuum duct 15. The beam is bent by a bending magnet 13 and circulated along a substantially circular orbit. The acceleration of the beam is carried out by induced electric field generated through magnetic induction by applying alternating excitation from an acceleration core power source 17 to an acceleration core 14. The beam circulates in the vacuum duct 15 so that the beam is prevented from impinging against air and thus being lost. Representative equilibrium orbits thereof are schematically represented by 16*a*, 16*b*, 16*c*, 16*d*.

The bending magnet 13 is excited by a power source 18 for the bending magnet. The acceleration core 14 and the acceleration core power source 17 will be referred to as accelerating means.

Figure 2:
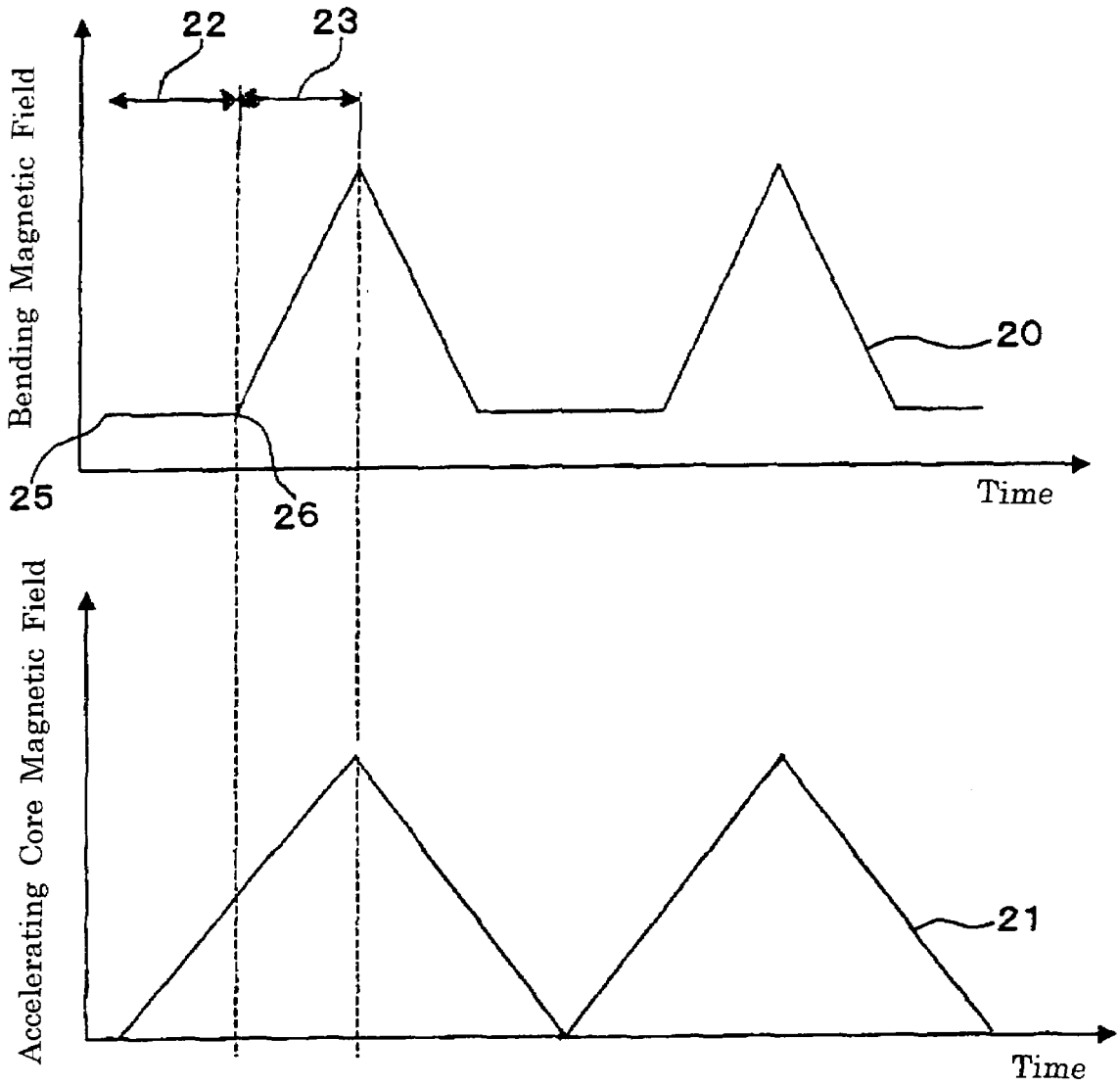
FIG. 2 is a diagram showing the time structures of bending magnetic field and accelerating core magnetic field according to an embodiment 1 of the present invention.

FIG. 2 shows time structures of bending magnetic field 20 generated by the bending magnet 13 and acceleration core magnetic field 21 generated in the acceleration core 14 to accelerate the beam in the charged particle accelerator 100 according to the embodiment 1 of the present invention.

The time structure of the bending magnetic field 20 and the time structure of the acceleration core magnetic field 21 shown in FIG. 2 do not satisfy a betatron acceleration condition. The betatron acceleration condition means the relationship between the bending magnetic field 20 and the acceleration core magnetic field 21 in which a beam circulating orbit during acceleration (equilibrium orbit) is constant.

In this embodiment 1, a first acceleration period 22 and a second acceleration period 23 for accelerating beam are provided as shown in the figures.

In the first acceleration period 22, beam emitted from the charged particle generating apparatus 11 such as an ion source or an electron gun is injected from the septum electrode 12 into the vacuum duct 15 at a beam injection start time 25 (first acceleration start time). As shown in the time structures of the acceleration core magnetic field 21, the acceleration core magnetic field 21 is varied to increase with time lapse from the beam injection start time 25 until the energy of the beam reaches predetermined energy. Accordingly, induced electric field is applied in the travel direction of the beam, and the beam injection at the time 25 is accelerated in the first acceleration period 22. During the first acceleration period 22, the bending magnetic field of the bending magnet 13 is fixed, and the beam is gradually expanded to the outside as indicated by the representative equilibrium orbits 16*a* to 16*d* of FIG. 1.

The beam is continuously injected during the first acceleration period 22, and thus a horizontally-expanding beam circulates in the charged particle accelerator 10 at the end time 26 of the first acceleration period 22.

At the end time 26 of the first acceleration period 22, the beam injected at the injection start time (the first acceleration start time) 25 circulates along the outermost orbit 16*d* with highest energy. Furthermore, the beam injected just before the injection end time 26 of the first acceleration period 22 circulates at the innermost orbit 16*a* with lowest energy. That is, the beam having a large energy dispersion and expanding horizontally circulates in the charged particle accelerator 100 at the first acceleration period end time 26. The magnetic pole shape of the bending magnet 13 is set in such a way that the magnetic field intensity is increased as the beam circulating orbit is shifted to the outside so that a beam deviated from an equilibrium orbit can circulate stably.

The acceleration period is shifted to the second acceleration period 23 after the first acceleration period 22 is finished at the time 26, that is, at the second acceleration start time 26. As shown in FIG. 2, the second acceleration period 23 has such an exciting pattern that both the bending magnetic field 20 and the acceleration core magnetic field 21 are increased with time. The exciting pattern is set so that beam acceleration is carried out while keeping the relationship between the bending magnetic field 20 and the acceleration core magnetic field 21 so that a condition near to the betatron acceleration condition is established in the charged particle accelerator 100, that is, the circulating orbit (equilibrium orbit) of the beam under acceleration is constant. The beam concerned is accelerated until the energy reaches predetermined energy while keeping the beam characteristics of large energy dispersion and horizontal expansion.

As described above, the beam whose energy has reached the predetermined energy is extracted from the circulating orbit by a deflector 30 shown in FIG. 1, and supplied to various kinds of beam applications by an emission beam transport system 31. Alternatively, the beam is made to impinge against an X-ray target 29 shown in FIG. 1 to generate X rays, and supplied to various kinds of X-ray applications.

As described above, in the charged particle accelerator 100 according to the embodiment 1 of the present invention, the space charge effect can be suppressed by a compact structure, and beam acceleration can be performed with high intensity which are from several tens times to several hundreds times as large as the conventional betatron accelerator.

In this embodiment, electrons are used as charged particles. However, the same acceleration can be performed for protons, carbons, etc. as charged particles. In this case, means of generating accelerating electric field may be an induced electric field as in the case of this embodiment, or a high-frequency electric field supplied from a high-frequency power source.

Embodiment 2

An embodiment 2 of the present invention will be described with reference to FIG. 3.

Figure 3:
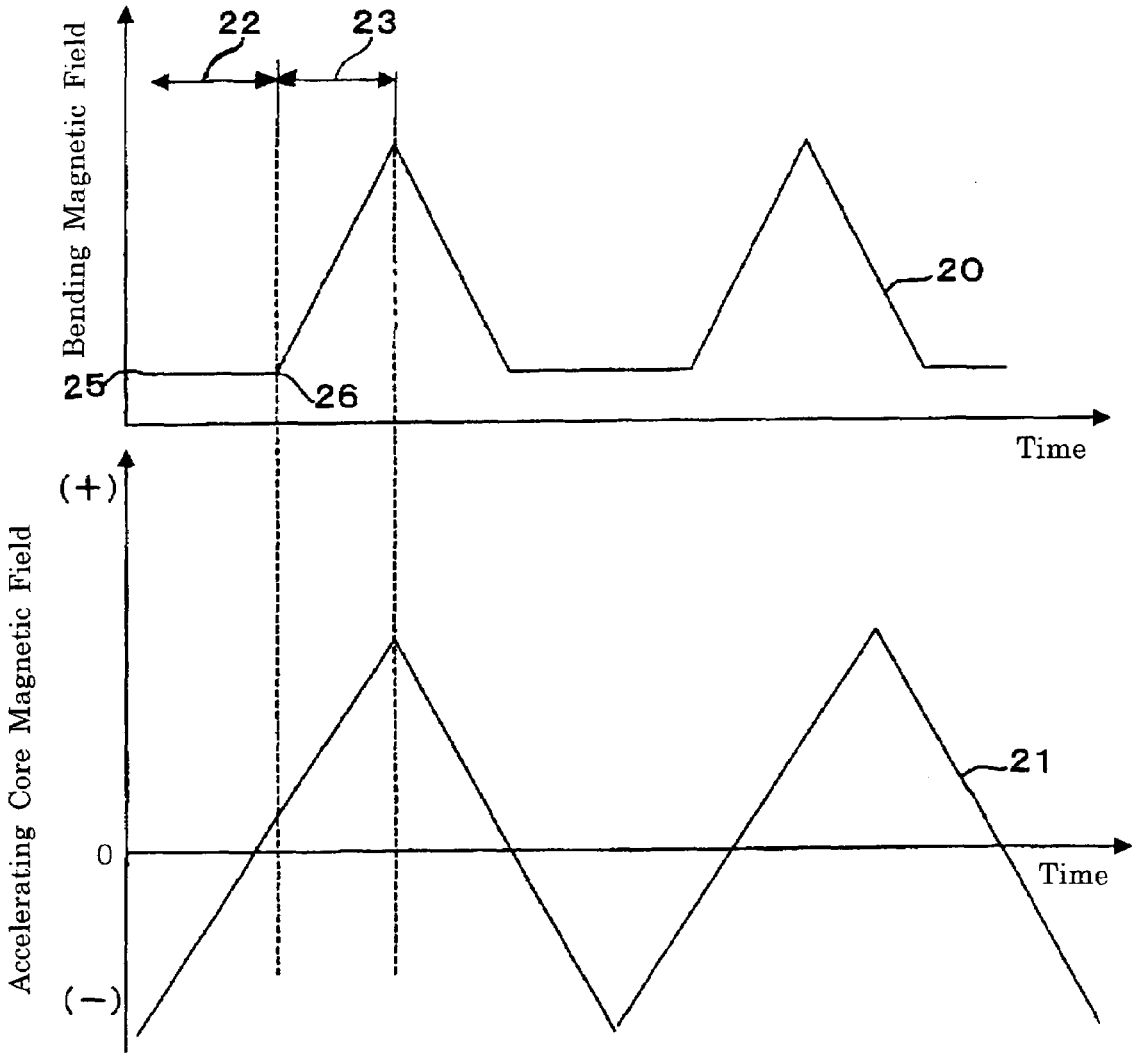
FIG. 3 is a diagram showing the time structures of bending magnetic field and accelerating core magnetic field according to an embodiment 2 of the present invention.

FIG. 3 is time structures of the bending magnetic field 20 and the acceleration core magnetic field 21 according to the embodiment 2 as in the case of the embodiment 1.

As shown in FIG. 3, in the embodiment 2 of the present invention, the acceleration core magnetic field 21 is applied such that it is set to a minus value at the start time 25 of the first acceleration period 22, that is, at the time point of the beam injection start time 25, and then increased in a plus direction with time lapse until the end time of the second acceleration period 23.

That is, the acceleration core magnetic field 21 exhibits such a time structure that positive and negative magnetic field occurs. When a beam is accelerated on the basis of the time structure of the acceleration core magnetic field 21 as described above, the space charge effect can be suppressed, and high power beam can be attained by a compact structure.

Embodiment 3

An embodiment 3 of the present invention will be described with reference to FIGS. 3 and 4.

Figure 4:
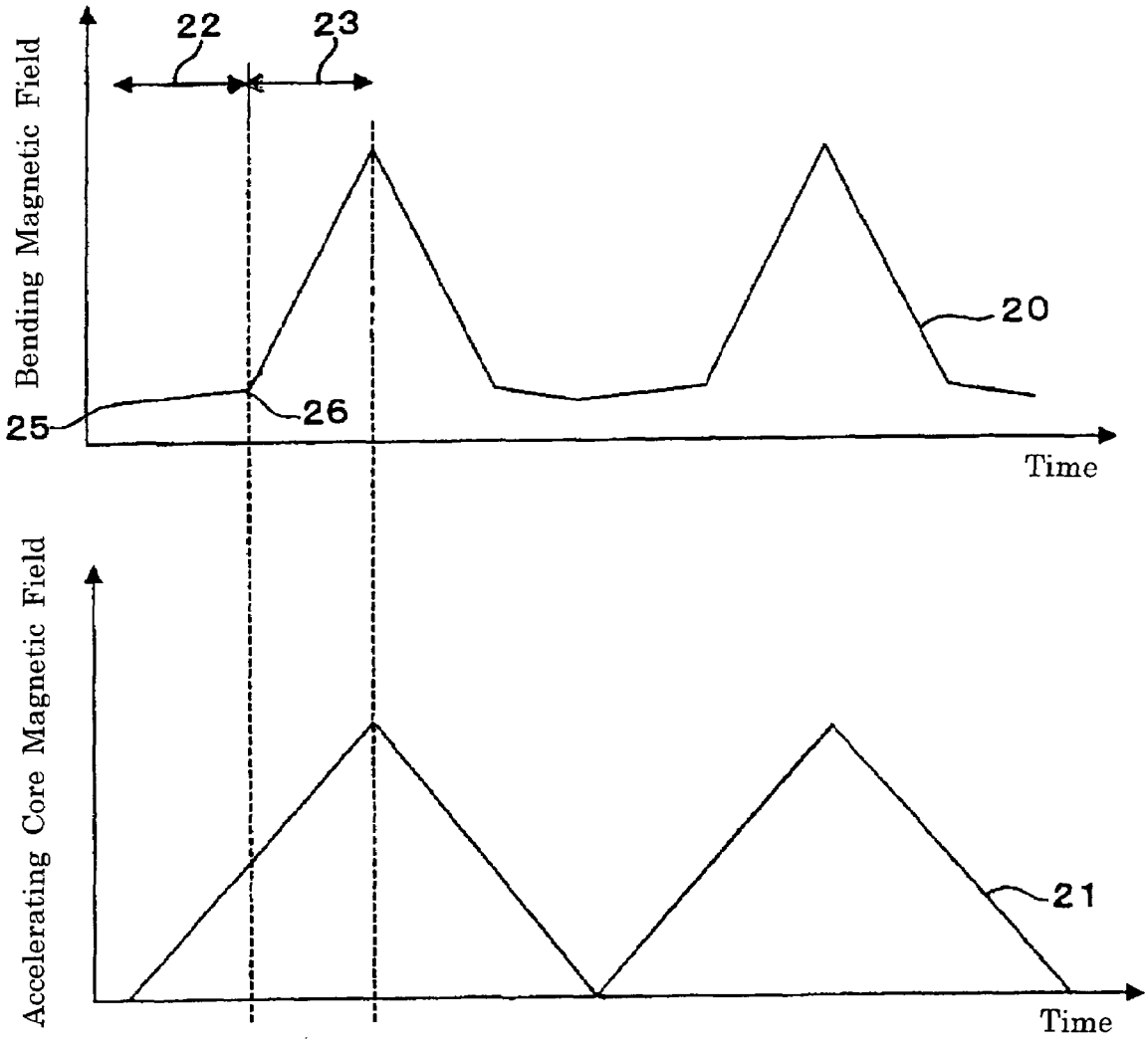
FIG. 4 is a diagram showing the time structures of bending magnetic field and accelerating core magnetic field according to an embodiment 3 of the present invention.

FIG. 4 is a diagram showing the time structures of the bending magnetic field 20 and the acceleration core magnetic field 21 in the embodiment 3.

In the embodiment 3, the time structure of the bending magnetic field 20 is increased with time lapse from the first acceleration period start time 25 until the first acceleration period end time 26. That is, the bending magnetic field 20 is varied during the first acceleration period 22. At this time, the beam energy of the charged particle generating apparatus 11 is required to be also varied. When the beam is accelerated on the basis of the time structure of the bending magnetic field 20 as described above, the space charge effect can be suppressed, and high power beam can be accelerated by a compact apparatus as in the case of the above embodiments.

Embodiment 4

An embodiment 4 of the present invention will be described with reference to FIG. 5.

Figure 5:
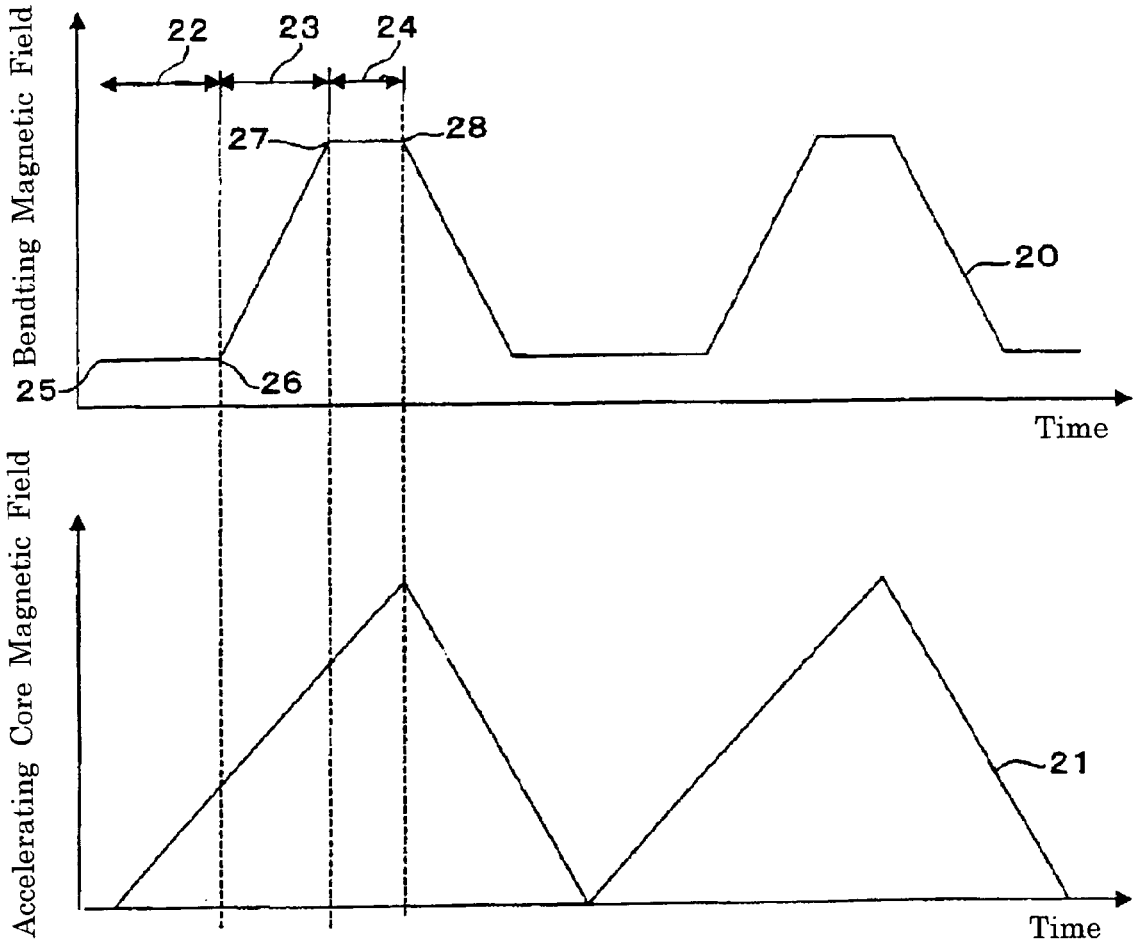
FIG. 5 is a diagram showing the time structures of bending magnetic field and accelerating core magnetic field according to an embodiment 4 of the present invention.

FIG. 5 is a diagram showing the time structures of the bending magnetic field 20 and the acceleration core magnetic field 21 in the embodiment 4.

In the embodiment 4, the time structure of each of the bending magnetic field 20 and the acceleration core magnetic field 21 has a first acceleration period 22, a second acceleration period 23 and a beam extraction period 24 subsequent to the second acceleration period 23 as shown in FIG. 5. The acceleration core magnetic field 21 is applied so as to increase with time lapse from the beam injection start time 25 until the end time 28 of the beam extraction period. The bending magnetic field 20 is applied so that the intensity thereof is fixed during the first acceleration period 22 and also is increased from the end time 26 of the first acceleration period 22, that is, the start time of the second acceleration period 23 until the end time 28 of the second acceleration period 23. During the beam extraction period 24, the bending magnetic field 20 is applied so that the terminal value of the second acceleration period 22 is kept constant until the end time 28.

During the beam extraction period 24, the beam is accelerated while keeping a large energy dispersion and horizontally expanding beam characteristic. The beam thus accelerated may be made to impinge against an X-ray target 29 shown in FIG. 1 to generate X-rays, and the X-rays are applicable to industrial or medical fields.

The details of the beam accelerating operation of the embodiment 4 will be described with reference to FIG. 1 and FIG. 5.

During the second acceleration period 23, the beam is accelerated while substantially keeping the beam dispersion in the horizontal direction, as indicated by the representative equilibrium orbits 16*a* to 16*d* of FIG. 1. When the outermost beam (corresponding to the equilibrium orbit 16*d*) reaches predetermined energy, that is, energy to be used at a user side, the period enters the beam extraction period 24 to start the beam extraction operation. This time corresponds to 27 of FIG. 5. In the beam extraction period 24, the increase of the bending magnetic field 20 of the bending magnet 13 is stopped, and controlled so as to keep such a relationship between the bending magnetic field 20 and the acceleration core magnetic field 21 kept that the equilibrium orbit of the beam under acceleration varies with time lapse.

Since the acceleration core magnetic field 21 varies even in the beam extraction period 24, the induced electric field is applied in the longitudinal direction of the charged beam, and the beams indicated by the representative equilibrium or bits 16*a*, 16*b*, 16*c* are gradually expanded to the outside.

When the user side is an X-ray user, the beam is made to impinge against the X-ray target 29 located at the outside of the circulating orbit to generate X-rays. That is, the X-rays can be generated during the beam extraction period 24 of FIG. 5. With respect to the beam energy when the beam impinges against the X-ray target 29, the energy of a beam which impinges against the X-ray target 29 at the beam extraction start time 27 is substantially equal to the energy of a beam which impinges against the X-ray target 29 at the beam extraction end time 28 because beam is also accelerated during the beam extraction period.

As described above, in the embodiment 4, when the beam is accelerated, the beam is accelerated keeping a large energy dispersion and horizontally expanding beam characteristic, and when the beam impinges against the X-ray target 29, the beam has substantially constant energy, so that X-rays having excellent quality can be achieved.

As described above, according to the charged particle accelerator of the embodiment 4, the space charge effect can be suppressed, a high power beam can be accelerated, and X-rays can be generated by using an excellent electron beam having a high intensity and substantially constant energy dispersion by a compact apparatus.

Embodiment 5

An embodiment 5 will be described with reference to FIG. 1.

In the embodiment 5 of the present invention, a deflector 30 is equipped as beam extraction means in place of the X-ray target 29 of the embodiment 4. In FIG. 1, the deflector 30 is equipped at a different position from the X-ray target 29, however, it may be located at the same position as the X-ray target 29. Magnetic field or electric field is applied to the deflector 30, and the beam extraction operation is started at the time when the outermost beam equilibrium orbit 16*d* reaches predetermined energy, that is, from the beam extraction start time 27 of FIG. 5. The bending magnetic field 20 and the acceleration core magnetic field 21 at the beam extraction time are the same as in the embodiment 4.

As described above, in the embodiment 5, when the beam is accelerated, the beam is accelerated with keeping the horizontally expanding beam characteristic having a large energy dispersion, however, when the beam reaches the emitted beam output transport system 31, it has substantially constant energy, and the beam having excellent quality can be extracted.

As described above, according to the charged particle accelerator of the embodiment 5, the space charge effect can be suppressed by the compact apparatus, and there can be achieved an effect that a high intensity beam can be accelerated and a high power beam having excellent quality can be achieved.

Embodiment 6

The charged particle accelerator of the present invention has the time structures of the bending magnetic field and the acceleration core magnetic field as shown in the embodiments 1 to 5. Therefore, the exciting pattern for exciting the bending magnet and the acceleration core may be linear as shown in FIGS. 2 to 5, or it is not necessarily linear and may be like a curved line or broken line.

Furthermore, a DC stabilized power source is not necessarily indispensable, and the setting precision of the exciting current to be required may be moderate. For example, a switching power source for switching DC voltage between ON and OFF may be used. Specifically, DC voltage is switched ON or OFF by a power semiconductor switching element such as IGBT, MOSFET or the like to create an exciting waveform.

The charged particle generating apparatus 11 is equipped at the center portion of the charged particle accelerator 10 in FIG. 1, however, the present invention is not limited to it. It may be equipped at the lower portion or upper portion of the charged particle accelerator 100, particularly at the upper portion proximate to the bending magnet 13 or at the upper portion, the overall apparatus can be miniaturized. The charged particle generating apparatus 11 can be disposed in the vacuum duct of the charged particle accelerator 100, which contributes to the miniaturization of the overall apparatus.

INDUSTRIAL APPLICABILITY

The charged particle accelerator of the present invention is applicable to industrial or medical fields such as an X-ray generating apparatus, a particle beam medical apparatus, etc.

The invention claimed is:

1. A charged particle accelerator comprising a charged particle generating apparatus, a bending magnet, accelerating means and a vacuum duct, characterized in that charged particles injected from the charged particle generating apparatus into the vacuum duct are bent by the bending magnet and accelerated to have prescribed energy after passing through a first acceleration period and a second acceleration period, electric field generated by the accelerating means is applied from the start time of the first acceleration period until the end time of the second acceleration period, and magnetic field generated by the bending magnet is applied at a fixed value during the first acceleration period and applied while being increased until the end time of the second acceleration period.

2. The charged particle accelerator according to claim 1, wherein the accelerating means comprises an acceleration core and an acceleration core power source, and electric field generated by the accelerating means is an induced electric field caused by subjecting the acceleration core to alternating excitation.

3. The charged particle accelerator according to claim 2, wherein the excitation of the acceleration core for causing the accelerating means to generate electric field is applied so as to be set to a minus value at the first acceleration period start time and increase in a plus direction until the second acceleration period end time.

4. The charged particle accelerator according to claim 1, wherein an excitation pattern for electric field application of the accelerating means and magnetic field application of the bending magnet is set to be linear.

5. The charged particle accelerator according to claim 1, wherein an excitation pattern for electric field application of the accelerating means and magnetic field application of the bending magnet is set to be a curved line.

6. The charged particle accelerator according to claim 1, wherein an X-ray target is equipped in the vacuum duct, and when the charged particles are accelerated so that the energy thereof reaches predetermined energy, the charged particles are made to impinge against the X-ray target to generate X-rays.

7. The charged particle accelerator according to claim 1, wherein a deflector is equipped in the vacuum duct, and when the charged particles are accelerated so that the energy thereof reaches predetermined energy, the charged particles are extracted by the deflector.

8. The charged particle accelerator according to claim 1, wherein the charged particle generating apparatus is equipped substantially at the center portion of the charged particle accelerator.

9. A charged particle accelerator comprising a charged particle generating apparatus, a bending magnet, accelerating means and a vacuum duct, characterized in that charged particles injected from the charged particle generating apparatus into the vacuum duct are bent by the bending magnet and accelerated to have prescribed energy after passing through a first acceleration period and a second acceleration period, a beam extraction period linked to the second acceleration period is provided, electric field generated by the accelerating means is applied from the start time of the first acceleration period until the end time of the extraction period, and magnetic field generated by the bending magnet is applied at a fixed value during the first acceleration period, the magnetic field is increased until the end time of the second acceleration period during the second acceleration period, and the magnetic field is set to a terminal value of the second acceleration period which is kept constant during the extraction period.

10. The charged particle accelerator according to claim 9, wherein the accelerating means comprises an acceleration core and an acceleration core power source, and electric field generated by the accelerating means is an induced electric field caused by subjecting the acceleration core to alternating excitation.

11. The charged particle accelerator according to claim 9, wherein the excitation of the acceleration core for causing the accelerating means to generate electric field is applied so as to beset to a minus value at the first acceleration period start time and increase in a plus direction until the second acceleration period end time.

12. The charged particle accelerator according to claim 9, wherein an excitation pattern for electric field application of the accelerating means and magnetic field application of the bending magnet is set to be linear.

13. The charged particle accelerator according to claim 9, wherein an excitation pattern for electric field application of the accelerating means and magnetic field application of the bending magnet is set to be a curved line.

14. The charged particle accelerator according to claim 9, wherein an X-ray target is equipped in the vacuum duct, and when the charged particles are accelerated so that the energy thereof reaches predetermined energy, the charged particles are made to impinge against the X-ray target to generate X-rays.

15. The charged particle accelerator according to claim 9, wherein a deflector is equipped in the vacuum duct, and when the charged particles are accelerated so that the energy thereof reaches predetermined energy, the charged particles are extracted by the deflector.

16. The charged particle accelerator according to claim 9, wherein the charged particle generating apparatus is equipped substantially at the center portion of the charged particle accelerator.

17. A charged particle accelerator comprising a charged particle generating apparatus, a bending magnet, accelerating means and a vacuum duct, characterized in that charged particles injected from the charged particle generating apparatus into the vacuum duct are bent by the bending magnet and accelerated to have prescribed energy after passing through a first acceleration period and a second acceleration period, electric field generated by the accelerating means is applied from the start time of the first acceleration period until the end time of the second acceleration period, magnetic field generated by the bending magnet is applied so as to increase from the acceleration start time of the first acceleration period until the end time of the second acceleration period, and the energy of the charged particles emitted from the charged particle generating apparatus in the first acceleration period is varied.

* * * * *